United States Patent [19]

Haga et al.

[11] 4,079,224

[45] Mar. 14, 1978

[54] METHOD FOR PREVENTING BRITTLE FRACTURE OF STEEL PIPE STRUCTURES

[75] Inventors: Hiroyo Haga, Tokyo; Tovoaki Bada, Machida; Sigeo Fujimori, Isehara; Tuguro Kikuno, Sagamihara; Hiroshi Nozaki, Omiya, all of Japan

[73] Assignee: Nippon Steel Corporation, Tokyo, Japan

[21] Appl. No.: 626,640

[22] Filed: Oct. 29, 1975

[30] Foreign Application Priority Data

Nov. 5, 1974 Japan ..... 49-127328

[51] Int. Cl.[2] ..... B23K 9/04

[52] U.S. Cl. ..... 219/107; 148/127; 219/137 R

[58] Field of Search ..... 148/127; 219/107, 162, 219/128, 137 R

[56] References Cited

U.S. PATENT DOCUMENTS

| | | | |
|---|---|---|---|
| 1,112,087 | 9/1914 | Patten | 219/162 |
| 1,606,894 | 11/1926 | Phelps | 219/107 |
| 2,041,343 | 5/1936 | Holslag | 219/162 |
| 2,429,320 | 10/1947 | Kennedy | 148/127 X |
| 2,812,419 | 11/1957 | Chyle | 219/128 X |

FOREIGN PATENT DOCUMENTS

| | | | |
|---|---|---|---|
| 74,563 | 7/1970 | Germany | 148/127 |

*Primary Examiner*—Arthur T. Grimley
*Assistant Examiner*—N. D. Herkamp
*Attorney, Agent, or Firm*—Toren, McGeady and Stanger

[57] ABSTRACT

A method of preventing brittle fracture of a pipe structure constructed by welding welded or continuous welded steel pipes, which comprise subjecting a certain length of the seamed portion adjacent to the butt welded portion of the steel pipe to an arc treatment.

18 Claims, 4 Drawing Figures

(a)

(b)

METHOD FOR PREVENTING BRITTLE FRACTURE OF STEEL PIPE STRUCTURES

BACKGROUND OF THE INVENTION

The present invention relates to a method for preventing brittle fractures of steel pipe structures, and more particularly a method for preventing brittle fractures of steel structures, such as pipe line and steel pipe structures constructed by welding steel pipes.

Generally in butt welding, large residual tensile stress is caused around weld lines in a direction parallel to the weld lines, and in some cases the stress reaches a value close to the yield point of the base metal. Also, various factors, such as angular distortion, dislocation, and blow holes, which concentrate the stress are very likely to occur near or in the welded portions, and it is almost impossible to eliminate these adverse factors completely.

Particularly in circumferential joints of the pipe lines, the above residual stress exists as a tension stress in the circumferential direction, and is superposed by the circumferential stress caused by the internal pressure of the pipe along the full length of the pipe line, or caused by the pressure from outside the pipe such as by the overlying ground or vehicles moving on the overlying ground, so that the circumferential joint portions are intermittently subjected to the peak of the circumferential stress.

Further, in case when a nozzle is to be connected by welding with a certain portion of the pipe line, it is known that strong concentration of stress appears in the nozzle joint portions.

And, when the end portions of steel pipes are butt-welded to other steel pipes, steel plates or flanges, high tensile stress is always caused in the circumferential direction, and it is impossible to avoid the tensile stress.

Particularly, in steel pipe structures constructed by welding steel pipes, where steel pipes of relatively large diameter are used as a main support for the frame and steel pipes of relatively small diameter are used as a branch support, tee (T) joints where the seam welded portions of the both steel pipes intercross with each other are considered to be most susceptible to brittle fracture.

Brittle fracture occurs when the following three factors exist. (1) presence of site of tensile stress, (2) presence of notches or defects and (3) shortness of steel toughness, and in the welded steel pipes notches and welding defects are expected to exist in their seam welded portions, and particularly in case of electric resistance welded steel pipes (ERW) and continuous welded steel pipes (CW), the welding defects take a planar shape so that the defects develop into notches, and in addition in the end portions of the steel pipes which are butt-welded there exists high tensile stress in the circumferential direction, and in particular when the toughness of the seamed or continuous welded portions is not enough, the above three factors responsible for brittle fracture initiation are now active and provide a condition under which the brittle fracture is most ready to occur.

In order to avoid the above condition, it may be considered to eliminate completely the welding defects along the full length of the seam of a welded steel pipe or continuous welded steel pipe, and to provide means of improving the steel toughness. But these measures require various complicated procedures and cause increase in the production cost of the steel pipes.

Therefore, it has been desired to eliminate factors which cause brittle fracture occurring at the joint portions of steel structures by means of simple procedures. All the proposals ever made, however, fail to satisfy the demand.

SUMMARY OF THE INVENTION

The present invention has its object in providing a method of eliminating factors which cause brittle fracture in the joint portions of steel structures by simple means, and the particular method is characterized in that the seamed portion of a welded or continuous welded steel pipe is arc treated along a certain length adjacent to the butt-welded portion when a steel pipe is constructed by welded steel pipes or continuous welded steel pipes.

DETAILED DESCRIPTION OF THE INVENTION

The present inventors have conducted various extensive studies for the above-mentioned purpose and have found that in constructing steel pipe structures by welding, when the seamed portion at the end of an arc welded steel pipe, ERW pipe or CW pipe, namely, the seamed portion adjacent to the butt-welded portion is subjected to an arc treatment, such as by remelting by the arc along a certain length ranging from about 100 to 150 mm adjacent to the pipe end portion, the toughness near the pipe end joint portion of the seamed portion is improved and not only welding defects which tend to develop into notches can be eliminated but also the residual stress distribution in the circumferential direction is changed and thereby the stress can be relieved. The present invention has been completed on the bases of the above discovery.

According to the present invention, all of the three factors responsible for brittle fracture initiation as mentioned hereinbefore can be eliminated by the improvement of toughness, the elimination of welding defects and the relief of residual stress. In addition it is to be noted that the method of the present invention is very simple and effective to prevent the brittle fracture.

The arc treatment used in the present invention includes overlaying by automatic or semi-automatic welding such as a submerged welding, arc-melting overlaying by TIG and carbon electrodes and the like. By this arc treatment, oxide inclusions which cause notches and welding defects such as undercuts can be eliminated and the bead shape can be corrected.

The treatment according to the present invention may be done at any stage, for example, it may be performed during or after the assembling process of steel pipe structures, in the manufacturing shop or even before or after the butt welding at the construction spot.

When the treatment according to the present invention is performed before the butt welding, particularly in case of the assembling in the manufacturing shop, even if deformation is caused in the pipe end by the welding thermal stress, the deformation can be corrected easily and it is possible to give the arc treatment to both the inside and the outside of the pipe.

When the treatment of the present invention is done after the butt welding on the spot, it is difficult to give the arc treatment to the inside of the pipe, but on the other hand there is no problem of the pipe end deformation so that the desired result can be obtained very easily.

The present invention will be more clearly understood from the following examples with reference to the accompanying drawings, in which.

EXAMPLE

Figure 1:
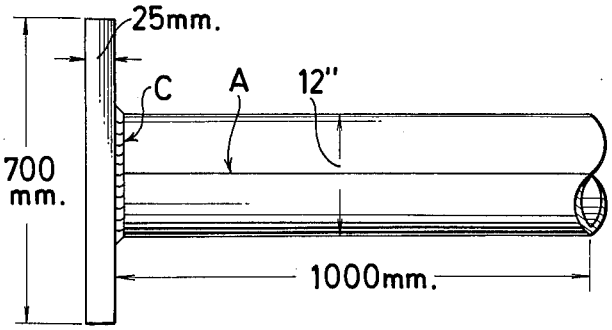
FIG. 1 shows shapes of test pieces used in examples of the present invention, and FIG. 1(*a*) relates to a conventional method, and FIG. 1(*b*) relates to the present invention.
Figure 1:
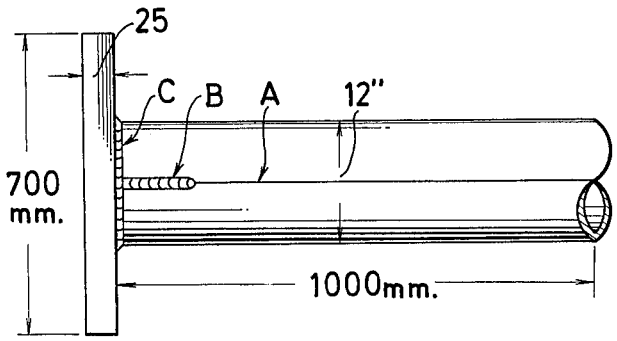

An electroseamed pipe of API5LX-X52 having 12 inches diameter 7.9 mm thickness and 1 m length was butt-welded in T to a steel plate of SM50 having 25 mm thickness as shown in FIG. 1(*a*) in which A is an electric resistance welded portion and C is a butt-welded bead.

Meanwhile, an ERW pipe the same as the above was given the arc treatment according to the present invention by applying submerged welding along a 150 mm length of the pipe to provide overlaying on both the inside and outside of the pipe as shown in FIG. 1(*b*), and then the steel pipe was butt-welded in T to the steel plate the same as the above. In FIG. 1(*b*), B is the overlayed bead. Strain gauges were attached to the pipes (*a*) and (*b*) in series with 50 mm spacing from the butt-welded portion to measure the circumferential residual stress. The results are shown in FIG. 2.

Figure 2:
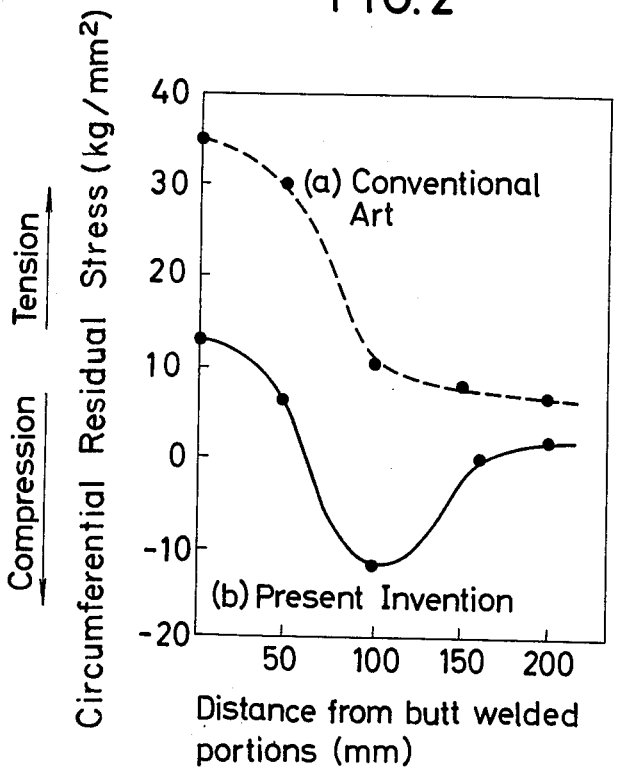
FIG. 2 shows relation between the distance from the butt-welded portion and the circumferential residual stress.

As clearly understood from FIG. 2, when the pipe is welded by the conventional art, residual tensile - stress almost equal to yield stress is caused in the butt-welded portion as shown by the curve of (*a*).

Whereas when the method of the present invention is applied, the circumferential residual stress is considerably relieved as shown by the curve (*b*) in FIG. 2 as compared with the curve (*a*).

Also, as clearly seen from FIG. 2, the circumferential residual stress decreases remarkably at a distance between 100 and 150 mm from the butt-welded portion, so that it is clear that the desired results of the present invention is remarkable when the arc treatment of the present invention is applied along a length ranging from 100 to 150 mm from the butt-welded portion.

In connection with the test piece to which the present invention as shown in FIG. 1(*b*) was applied, 2 mm V charpy impact test pieces of ⅔ sub-size were taken from the overlayed portion B and the electric resistance welded portion A (having no overlaying), and impact tests were done. The results are shown in FIG. 3.

Figure 3:
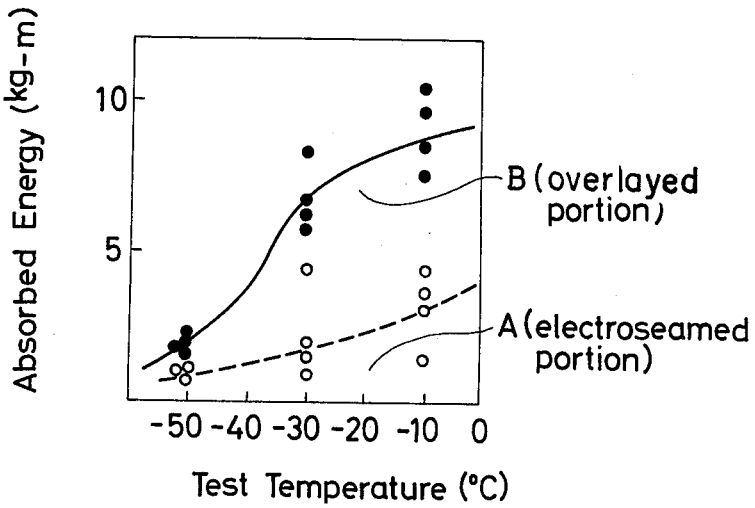
FIG. 3 shows impact test results of a electric resistance welded portion and of an overlayed portion.

As clearly understood from FIG. 3, the ductile-brittle transition temperature of the treated portion (B) is 30° C lower than that of the as electric resistance welded portion (A), and the absorbed energy at the same temperature is also higher in the overlayed portion (B). These results clearly demonstrate remarkable improvement in toughness can be obtained by the present invention.

By application of the arc treatment of the present invention, any defect such as penetraters which possibly develop into notches can be eliminated from the arc tested portion.

As described above, the three factors responsible for brittle fracture initiation are all eliminated by the present invention, and thus the present invention is very effective in preventing the brittlement fracture.

In the above example, only the submerged welding as the improving measures is illustrated, but similar results can be obtained by the treatment using TIG or a carbon electrode.

In this way, the brittlement fracture of pipe structures can be prevented by simple means when the present invention is applied, and thus the present invention brings forth very remarkable industrial advantages.

What is claimed is:

1. A method of preventing brittle fracture of a pipe structure constructed by butt welding a continuous welded steel pipe to a second member, which comprises subjecting a certain length of the portion of the continuous weld adjacent said butt weld to an arc treatment which comprises arc remelting or laying a bead of weld material over the continuous weld.

2. A method according to claim 1, in which the arc treatment is done along a length ranging from 100 to 150 mm from the steel pipe end.

3. A method as in claim 2, wherein the arc treatment comprises laying a bead of weld material over the continuous weld.

4. A method according to claim 1, in which the arc treatment is done before butt welding of the steel pipes.

5. A method as in claim 4, wherein the arc treatment comprises laying a bead of weld material over the continuous weld.

6. A method according to claim 1, in which the arc treatment is done after butt welding of the steel pipes.

7. A method as in claim 6, wherein the arc treatment comprises laying a bead of weld material over the continuous weld.

8. A method as in claim 1, wherein the arc treatment comprises laying a bead of weld material over the continuous weld.

9. A method of joining a tube having a welded seam and an end to another member, comprising the steps of butt welding the end of the tube to the other member and arc treating a portion of the tube along the seam adjacent the end at a time different from the butt welding step; said arc treating step including applying, along the seam, an arc producing sufficient heat to remelt the tube at the seam and allowing the seam to cool.

10. A method as in claim 9, wherein the arc treating step includes depositing a layer of metal on the portion of the seam by means of the arc.

11. A method as in claim 10, in which the arc treatment is done along a length ranging from 100 to 150 mm from the steel pipe end.

12. A method as in claim 10, in which the arc treatment is done before butt welding of the steel pipes.

13. A method as in claim 10, in which the arc treatment is done after butt welding of the steel pipes.

14. A method of protecting a pipe, having a welded seam and an end butt welded to another structure, comprising the step of arc treating the pipe at a portion of the seam adjacent the end at a time different from the butt welding, and allowing the pipe to cool, said arc treating step including applying along the seam, an arc producing sufficient heat to remelt the tube at the seam.

15. A method as in claim 14, comprising the steps of butt welding the end of the tube to the other member and arc treating a portion of the tube along the seam adjacent the end at a time different from the butt welding step; said arc treating step including applying, along the seam, an arc producing sufficient heat to remelt the tube at the seam and allowing the seam to cool.

16. A method as in claim 15, in which the arc treatment is done along a length ranging from 100 to 150 mm from the steel pipe end.

17. A method as in claim 15, in which the arc treatment is done before butt welding of the steel pipes.

18. A method as in claim 15, in which the arc treatment is done after butt welding of the steel pipes.

* * * * *